US009808940B1

(12) United States Patent
Sakai

(10) Patent No.: US 9,808,940 B1
(45) Date of Patent: Nov. 7, 2017

(54) FOLDING KNIFE WITH BLADE OPEN ASSISTING FUNCTION

(71) Applicant: Gerber Sakai Co., Ltd., Gifu-ken (JP)

(72) Inventor: Kimiyuki Sakai, Seki (JP)

(73) Assignee: GERBER SAKAI CO., LTD., Gifu-Ken (JP)

( * ) Notice: Subject to any disclaimer, the term of this patent is extended or adjusted under 35 U.S.C. 154(b) by 0 days.

(21) Appl. No.: 15/222,733

(22) Filed: Jul. 28, 2016

(51) Int. Cl.
*B26B 1/02* (2006.01)
*B26B 1/04* (2006.01)

(52) U.S. Cl.
CPC ..... *B26B 1/042* (2013.01); *B26B 1/02* (2013.01)

(58) Field of Classification Search
CPC ..... B26B 1/02; B26B 1/042
USPC ..... 30/158, 159
See application file for complete search history.

(56) References Cited

U.S. PATENT DOCUMENTS 6,308,420 B1 * 10/2001 Moser ..... B26B 1/04 30/158
7,293,360 B2 * 11/2007 Steigerwalt ..... B26B 1/02 30/159
7,437,822 B2 * 10/2008 Flagg ..... B26B 1/044 30/160
7,562,454 B2 * 7/2009 Steigerwalt ..... B26B 1/02 30/159
7,748,122 B2 * 7/2010 Duey ..... B26B 1/048 30/159
8,171,645 B2 * 5/2012 Duey ..... B26B 1/048 30/159
8,499,460 B1 * 8/2013 Pearman ..... B26B 1/044 30/155
9,505,141 B2 * 11/2016 Duey ..... B26B 1/046
9,527,218 B2 * 12/2016 Valdez ..... B26B 1/044
2004/0261272 A1 * 12/2004 Moser ..... B26B 1/04 30/160
2005/0223562 A1 * 10/2005 Pardue ..... B26B 1/046 30/161
2008/0201953 A1 * 8/2008 Bremer ..... B26B 1/046 30/1
2009/0277015 A1 * 11/2009 Duey ..... B26B 1/046 30/160
2010/0192381 A1 * 8/2010 Sakai ..... B26B 1/048 30/160
2011/0099817 A1 5/2011 Duey
2015/0352730 A1 * 12/2015 Duey ..... B26B 1/046 30/159

(Continued)

*Primary Examiner* — Hwei C Payer
(74) *Attorney, Agent, or Firm* — James R. Gourley; Carstens & Cahoon, LLP

(57) ABSTRACT

A folding knife includes a handle having a pivot axis, a blade attached to the handle, a movable member that moves about the pivot axis, an urging spring, and a switching mechanism. The movable member has an engaging claw. When the blade is in a folded position, the switching mechanism holds the movable member in a disengaged state, in which the engaging claw is disengaged from an engaging portion of the blade. When the blade moves from the folded position to the switching position, the switching mechanism switches the movable member from the disengaged state to an engaged state, in which the engaging claw is engaged with the engaging portion, thereby moving the movable member in the open direction by the urging spring to move the blade from the switching position toward the open position by the movable member.

6 Claims, 6 Drawing Sheets

(56) References Cited

U.S. PATENT DOCUMENTS

2015/0352731 A1* 12/2015 France ..... B26B 1/048
30/159

* cited by examiner

FOLDING KNIFE WITH BLADE OPEN ASSISTING FUNCTION

BACKGROUND

The present disclosure relates to a folding knife that has a blade open assisting function for assisting pivotal movement of a blade from a folded position to an open position performed by a user.

An ordinary folding knife includes a handle and a blade pivotally supported at the distal end of the handle. The blade is movable between a folded position (non-use position), in which the blade is received within a receiving groove of the handle, and an open position (use position), in which the blade extends out of the handle. Some of such folding knives have a blade open assisting function to assist pivotal movement of the blade from the folded position to the open position performed by the user. Although various types of these folding knives with a blade open assisting function have been proposed and used conventionally, there still is a demand for a knife that is highly reliable and has a special configuration.

Accordingly, it is an objective of the present disclosure to provide a novel and improved folding knife with a blade open assisting function.

To achieve the above objective, a folding knife includes a handle having a pivot axis, a blade attached to the handle, a movable member configured to move about the pivot axis, an urging spring, and a switching mechanism. The blade is configured to pivot about the pivot axis to move between a folded position, at which the blade is received in the handle, and an open position, at which the blade extends out of the handle. A direction in which the blade moves from the folded position toward the open position is an open direction. The blade includes an engaging portion. The movable member includes an engaging claw capable of being engaged with the engaging portion of the blade. The urging spring urges the movable member in the open direction. The switching mechanism is configured to switch the movable member between an engaged state, in which the movable member is movable relative to the handle and the engaging claw is engaged with the engaging portion of the blade, and a disengaged state, in which movement of the movable member relative to the handle is restricted and the engaging claw is disengaged from the engaging portion. When the blade is in the folded position, the switching mechanism holds the movable member in the disengaged state. When the blade has moved from the folded position to a switching-position, which is between the folded position and the open position, the switching mechanism switches the movable member from the disengaged state to the engaged state, thereby moving the movable member in the open direction by the urging spring so that the blade is moved from the switching position toward the open position by the movable member.

Other aspects and advantages of the present disclosure will become apparent from the following description, taken in conjunction with the accompanying drawings, illustrating by way of example the principles of the disclosure.

BRIEF DESCRIPTION OF THE DRAWINGS

The features of the present disclosure that are believed to be novel are set forth with particularity in the appended claims. The disclosure, together with objects and advantages thereof, may best be understood by reference to the following description of the presently preferred embodiments together with the accompanying drawings in which;

DETAILED DESCRIPTION

Figure 1:
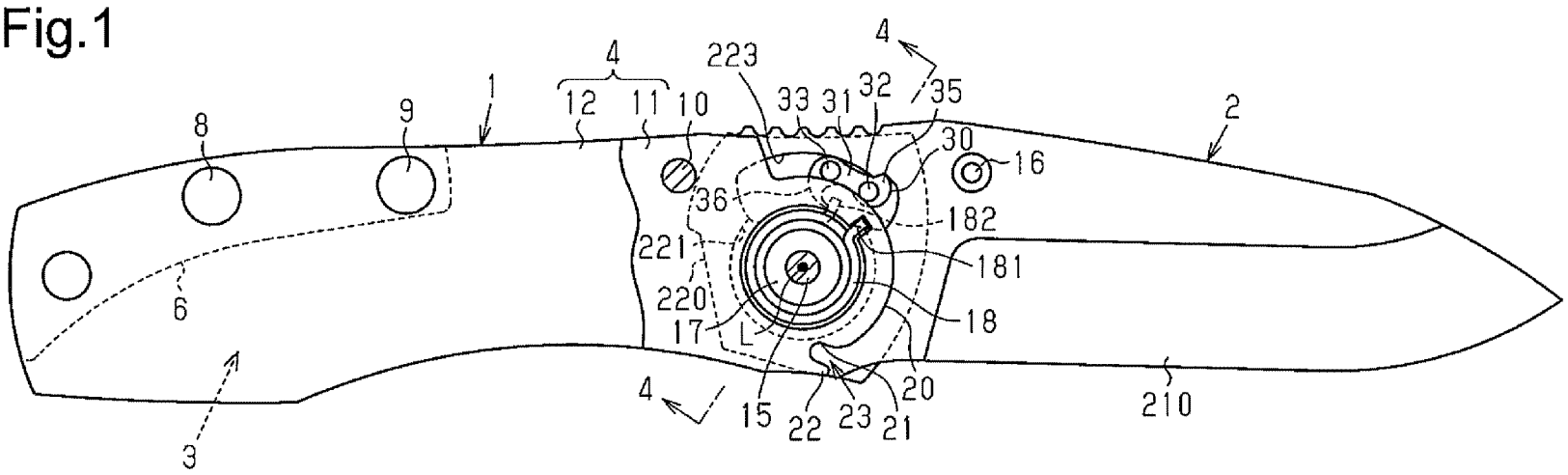
FIG. 1 is a front view with parts cut away of a folding knife according to one embodiment of the present disclosure, with the blade in an open position.
Figure 2:
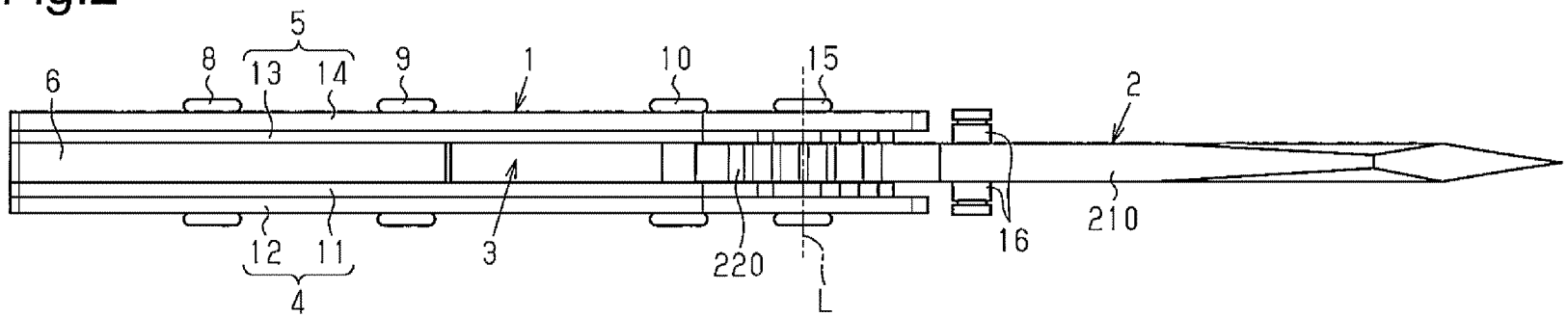
FIG. 2 is a plan view of the knife in FIG. 1.
Figure 3:
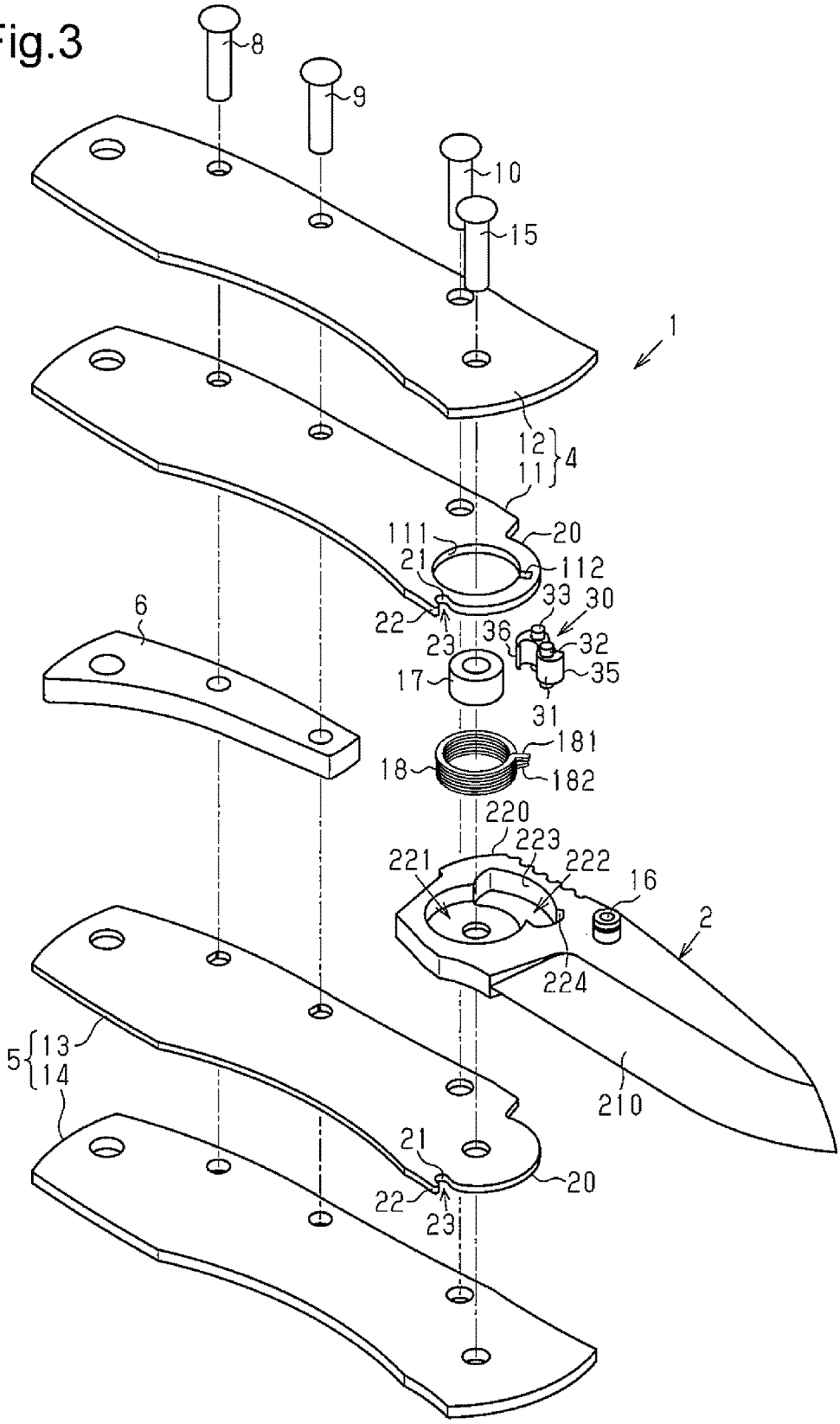
FIG. 3 is an exploded perspective view of the knife in FIG. 1.
Figure 4:
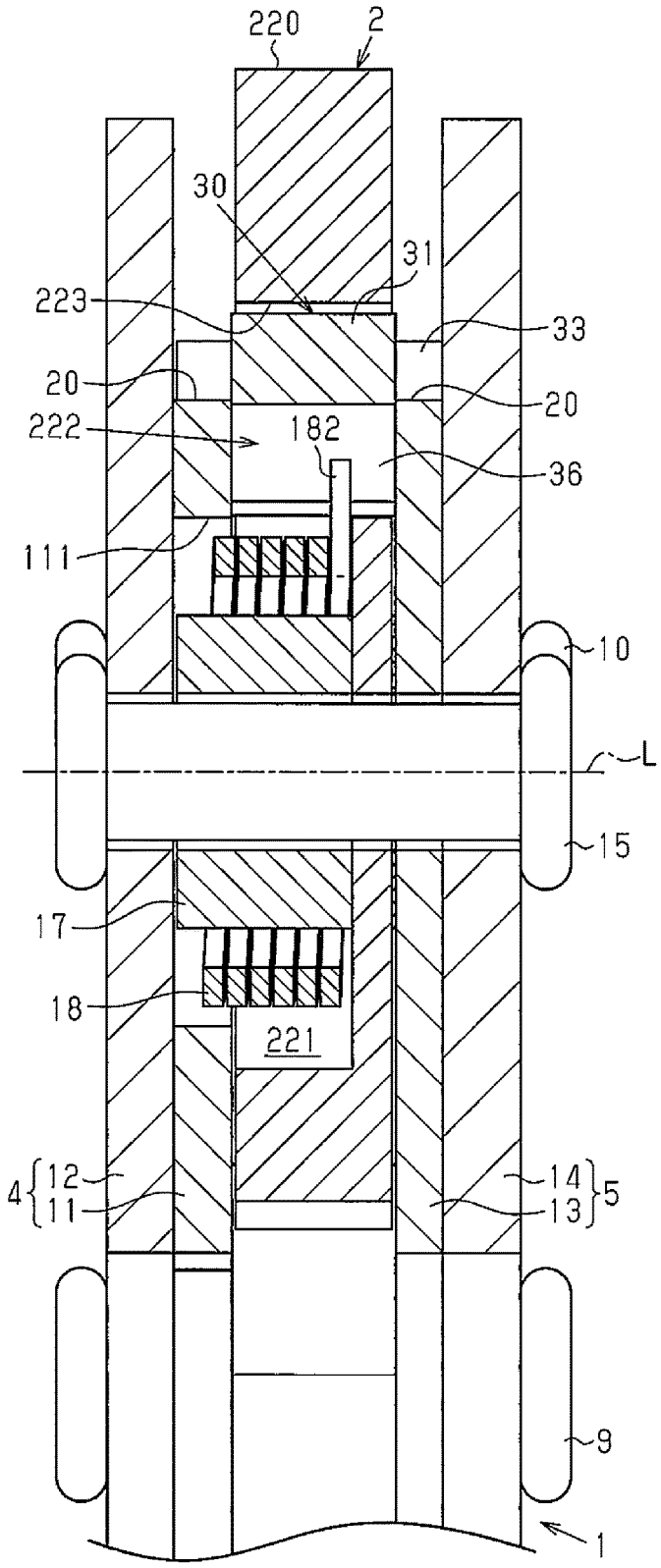
FIG. 4 is a cross-sectional view taken along line 4-4 of FIG. 1.

One embodiment of the present disclosure will now be described with reference, to the attached drawings. As shown in FIGS. 1 to 5, a folding knife with a blade open assisting function includes a handle 1 and a blade 2, which is pivotally attached to the distal portion of the handle 1. The blade 2 is movable between a folded position (see FIG. 4), in which the blade is received within a receiving groove 3 of the handle 1, and an open position (see FIG. 1), in which the blade extends out of the handle 1. The folded position corresponds to a non-use position of the blade 2, and the open position corresponds to a use position of the blade 2. In the following description, a direction in which the blade 2 moves from the folded position to the open position is referred to as an open direction, and a direction in which the blade 2 moves from the open position to the folded position is referred to as a folding direction.

The handle 1 has first and second sidewalls 4 and 5, which are spaced apart at a predetermined interval. A spacer plate 6, which is formed of, e.g., metal material, is provided between the two sidewalls 4 and 5 on the basal side of the handle 1. The two sidewalls 4 and 5 are joined together by first and second coupling pins 8 and 9 with the spacer plate 6 held between the sidewalls 4 and 5. Each of the first and second coupling pins 8 and 9 extends through the spacer plate 6 and the sidewalls 4 and 5. A stopper pin 10, which extends through the sidewalls 4 and 5, is arranged on the distal side of the handle 1. The receiving groove 3 is defined between the sidewalls 4 and 5, which are spaced apart by the spacer plate 6. The first sidewall 4 has a liner plate 11 and an outer plate 12 arranged on the outer side of the liner plate 11. Similarly, the second sidewall 5 has a liner plate 13 and an outer plate 14 arranged on the outer side of the liner plate 13. The two liner plates 11 and 13 are preferably formed of metal material. Although the two outer plates 12 and 14 may also be formed of metal material, the outer plates 12, 14 may be formed of synthetic plastic material, wooden material, or the like.

A blade shaft 15 extends through the two sidewalls 4 and 5 and the blade 2 at the distal portion of the handle 1. The blade 2 has a blade portion 210 and a tang 220, which is formed at the basal portion of the blade portion 210. The tang 220 is pivotally supported by the blade shaft 15. The axis L of the blade shaft 15 is the pivot axis L of the blade 2 and extends in a direction orthogonal to the handle 1 and the blade 2. The tang 220 is arranged inside the handle 1 and held by the two liner plates 11 and 13 from both sides. A knob 16 extends from either side of the blade portion 210 in the vicinity of the basal portion of the blade portion 210. A user may pivot the blade 2 from the folded position to the open position by operating the knobs 16 with his or her fingers or by pulling the part of the blade 2 exposed from the handle 1 with his or her fingers. The knob 16 may extend only from one side of the blade portion 210.

The tang 220 has a circular receiving recess 221 centered at the pivot axis L and a receiving hole 222, which is continuous with the receiving recess 221 and extends in an arcuate shape about the pivot axis L. A portion of the inner face of the receiving hole 222 that is located radially outward (portion that faces radially inward) includes an outer guide surface 223, which extends in an arcuate shape about the pivot axis L, and an engaging surface (engaging portion) 224, which extends radially outward from one end in the circumferential direction of the outer guide surface 223. That is, a part of the receiving hole 222 is defined by the outer guide surface 223 and the engaging surface 224. The receiving hole 222 flares radially outward of the outer guide surface 223 at a location corresponding to the engaging surface 224.

The liner plate 11, which is one of the liner plates that faces the receiving recess 221, has a circular receiving hole 111 centered at the pivot axis L. A cylindrical bushing 17 and a torsional spring 18 are arranged in a receiving space formed by the receiving hole 111 and the receiving recess 221. The bushing 17 is arranged around the blade shaft 15, and the torsional spring 18, which is an urging spring, is arranged around the bushing 17.

The torsional spring 18 has a first end 181 and a second end 182, which extend radially outward. The liner plate 11 has an engaging groove 112, which extends radially outward from the inner circumferential surface of the receiving hole 111, and the first end 181 of the torsional spring 18 is engaged with the engaging groove 112. In other words, the first end 181 of the torsional spring 18 is engaged with the handle 1 not to move relative to the handle 1.

The distal portion of the handle 1, in particular, the distal portion in each liner plate 11, 13 has an inner guide surface 20, which extends in an arcuate shape about the axis of the blade shaft 15 (pivot axis), and a holding surface (holding portion) 21, which extends radially inward from one end in the circumferential direction of the inner guide surface. The inner guide surface 20 and the holding surface 21 face radially outward and are arranged radially inside the outer guide surface 223. Each liner plate 11, 13 has a jaw portion (projection) 22 that faces the holding surface 21. The jaw portion 22 and the holding surface 21 define a holding recess 23. At least a part of the holding recess 23 is located radially inside the inner guide surface 20.

A movable member 30 is arranged in the receiving hole 222. The movable member 30 is movable about the pivot axis L along the inner guide surfaces 20 of the liner plates 11 and 13. The movable member 30 has a body 31, which is arranged to radially face the outer guide surface 223, and first and second pins 32 and 33, which are respectively inserted into the first and second ends of the body 31 and fixed. The pins 32, 33 function as projections that extend from the opposite sides of the body 31 along the pivot axis L and radially face the inner guide surfaces 20 of the liner plates 11 and 13. The pins 32, 33 are guided portions, which are guided by the inner guide surfaces 20 to move along the inner guide surfaces 20.

The body 31 further has a first engaging claw 35, which projects radially outward at the first end of the body 31, and a second engaging claw 36, which projects radially inward at the second end of the body 31. The second end 182 of the torsional spring 18 is engaged with the second engaging claw 36. The torsional spring 18 urges the movable member 30 in the open direction.

The inner guide surfaces 20, the holding surfaces 21, the outer guide surface, the engaging surface 224, and the like constitute a switching mechanism that switches the movable member 30 between an engaged state (movable state) and a disengaged state (restricted state). In the engaged state, the movable member 30 is movable relative to the handle 1 and the first engaging claw 35 is engaged with the engaging surface 224. In the disengaged state, the movement of the movable member 30 relative to the handle 1 is restricted and the first engaging claw 35 is disengaged from the engaging surface 224.

Figure 5:
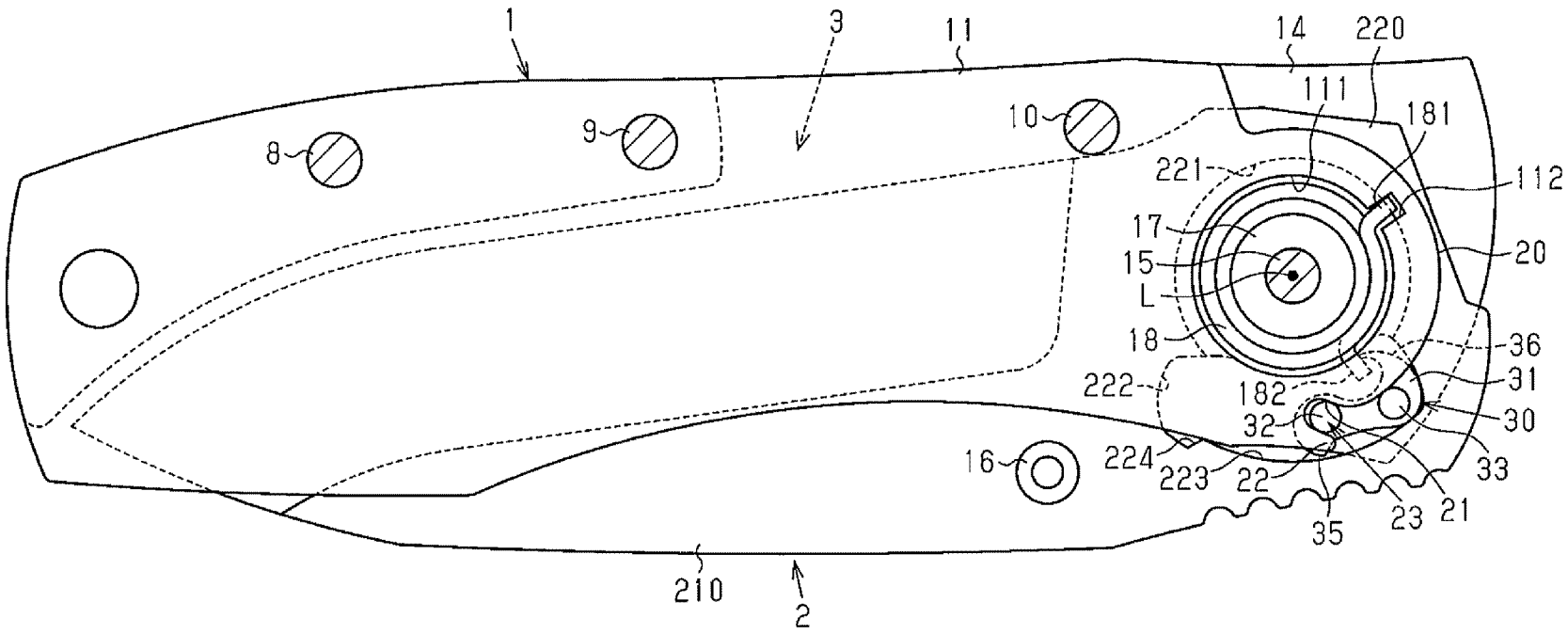
FIG. 5 is a front cross-sectional view of the knife in FIG. 1, with the blade in a folded position.

Referring to FIG. 1 and FIGS. 5 to 9, the opening operation of the blade 2 will be described sequentially. In FIGS. 5 to 9, the outer plate 12 is omitted. FIG. 5 shows a state of the blade 2 in the folded position. In this state, the blade 2 is preferably locked to the handle 1 to be held in the folded position by a known lock mechanism, which is not illustrated in the drawing. Also in this state, the first pin 32 of the movable member 30 is located inside the holding recesses 23 of the liner plates 11 and 13 and is engaged with the holding surfaces 21, and the second pin 33 of the movable member 30 is engaged with the inner guide surfaces 20 of the liner plates 11 and 13. The outer guide surface 223 of the blade 2 radially faces the first engaging claw 35 to restrict radially outward movement of the first engaging claw 35 of the movable member 30. This prevents the first pin 32 from separating from the holding surface 21 (i.e., the holding recess 23).

The holding surface 21 extends radially inward from the inner guide surface 20. At least a part of the first pin 32, which is located in the holding recess 23, is located radially inside the inner guide surface 20. Thus, as long as the radially outward movement of the first engaging claw 35 is restricted, the first pin 32 cannot be removed from the holding recess 23, and the movable member 30 cannot move in the opening direction. In other words, when the blade 2 is in the folded position, the switching mechanism (20, 21, 223, and 224) holds the movable member 30 in the disengaged state, in which the movement of the movable member 30 relative to the handle 1 is restricted and the first engaging claw 35 is disengaged from the engaging surface 224.

The movable member 30 receives the urging force of the torsional spring 18. Thus, in a state in which the movement of the movable member 30 in the opening direction is restricted, the urging force of the torsional spring 18 does not act on the blade 2. Thus, the urging force of the torsional spring 18 does not act on the lock mechanism that locks the blade 2 in the folded position. Thus, the lock mechanism can be designed without considering the urging force of the torsional spring 18. Even when lock by the lock mechanism is unintentionally cancelled, the blade 2 is restrained from unexpectedly projecting from the receiving groove 3.

Figure 6:
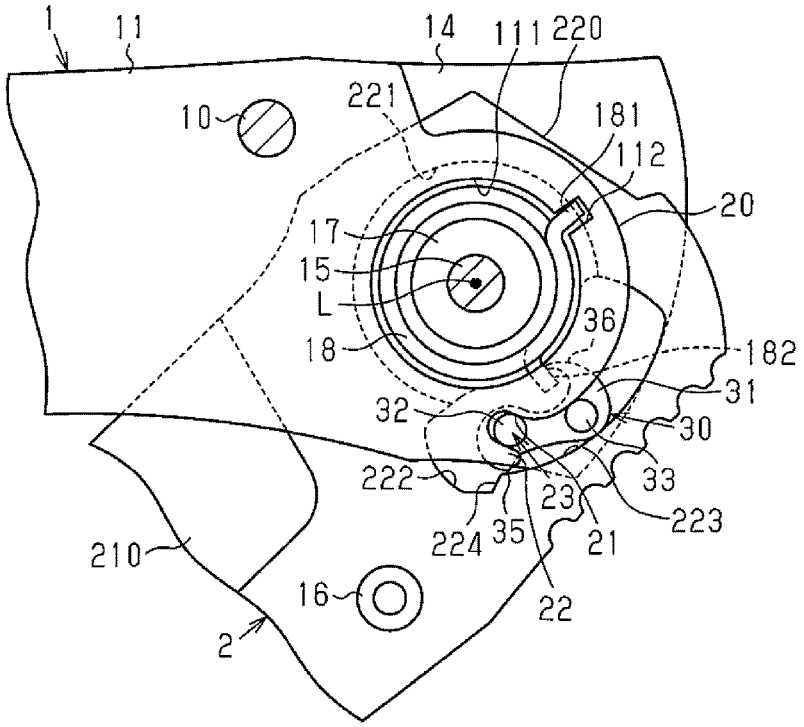
FIGS. 6 to 9 are front cross-sectional views of the knife in FIG. 1, sequentially illustrating the opening operation of the blade.
Figure 7:
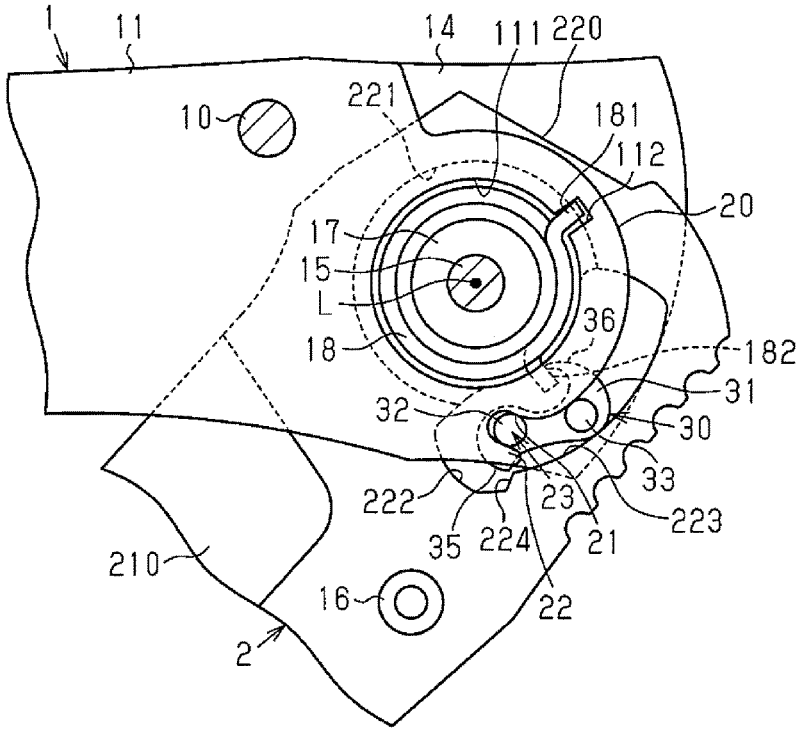

FIG. 7 shows a state of the blade 2 moving from the folded position, which is shown in FIG. 5, to a switching position. The switching position is a position between the folded position. and the open position. FIG. 6 shows a state of the blade 2 that has moved to a position immediately before the switching position shown in FIG. 7. In this state shown in FIG. 6, similar to the state shown in FIG. 5, the outer guide surface 223 still radially faces the first engaging claw 35 to restrict radially outward movement of the first engaging claw 35. This still prevents the first pin 32 from separating from the holding surface 21. That is, the movement of the movable member 30 in the opening direction is still restricted.

Figure 8:
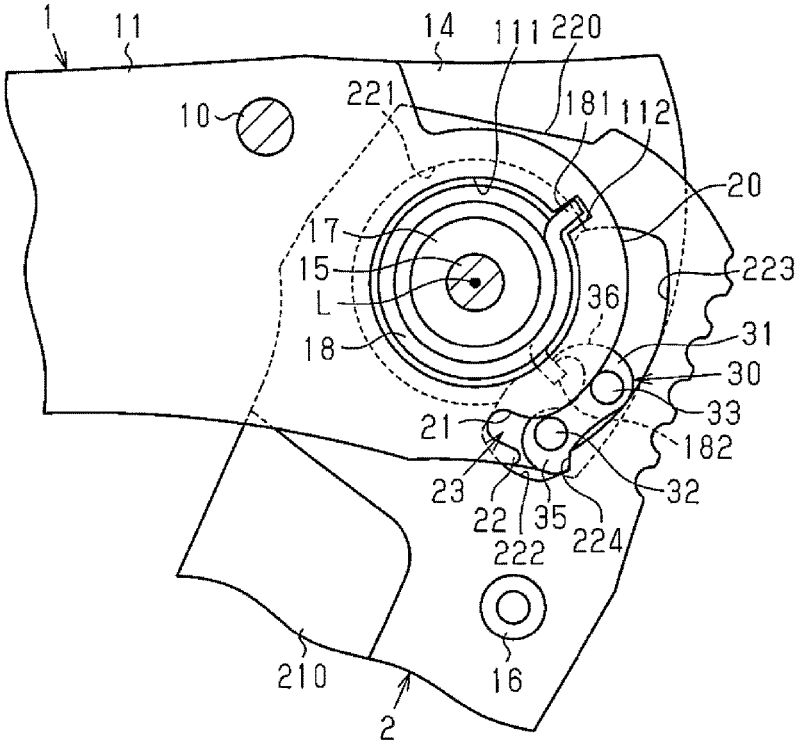

When the blade 2 has moved to the switching position shown in FIG. 7, the engaging surface 224 of the blade 2 is located at a position at which the engaging surface 224 radially faces the first engaging claw 35. In other words, the space that is expanded radially outward of the outer guide surface 223 by the engaging surface 224 is located at a position that radially faces the first engaging claw 35. This allows the first engaging claw 35 to move radially outward and allows the first pin 32 to separate from the holding surface 21 (the holding recess 23). Thus, the movable member 30 is also allowed to move in the opening direction. Therefore, as shown in FIG. 8, while the urging force of the torsional spring 18 moves the movable member 30 in the opening direction, the first pin 32 moves from the holding surface 21 to the inner guide surface 20. Along with this, the first engaging claw 35 moves radially outward and is engaged with the engaging surface 224. In other words, when the blade 2 has moved to the switching position, the switching mechanism (20, 21, 223, and 224) switches the movable member 30 from the disengaged state to the engaged state, in which the movable member 30 is movable relative to the handle 1 and the first engaging claw 35 is engaged with the engaging surface 224.

Figure 9:
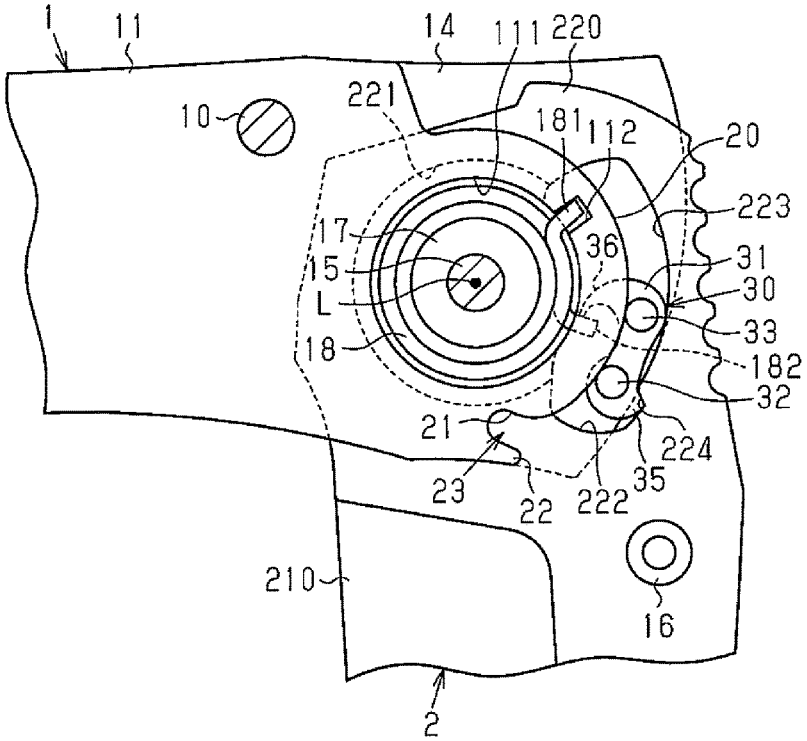

After that, as shown in FIG. 9, the movable member 30 is moved in the opening direction by the torsional spring 18 so that the first pin 32 and the second pin 33 move along the inner guide surface 20. Thus, the blade 2 is moved to the open position shown in FIG. 1 from the switching position shown in FIG. 7 by the first engaging claw 35, which is engaged with the engaging surface 224. When the blade 2 is pivoted to the open position as shown in FIG. 1, the outer circumferential edge of the tang 220 is engaged with the stopper pin 10 to prevent the blade 2 from being pivoted beyond the open position.

In the state shown in FIG. 1, the blade 2 is preferably locked to the handle 1 to be held in the open position by a known lock mechanism, which is not shown in the drawing. The lock mechanism that locks the blade 2 in the open position may also serve as the lock mechanism that locks the blade 2 in folded position. Alternatively, separate lock mechanisms may be provided.

In a state in which the blade 2 is in the open position shown in FIG. 1, when the user presses the blade 2 in the folding direction against the urging force of the torsional spring 18, the blade 2 moves toward the folded.

In a process in which the blade 2 moves from the open position to the switching position, the movable member 30 is moved with the blade 2 in the folding direction by the engaging surface 224 of the blade 2, which is engaged with the first engaging claw 35. In a process in which the blade 2 moves toward the folded position beyond the switching position, the jaw portion 22 guides the first pin 32 to the holding surface 21 (within the holding recess 23), and along with this, the first engaging claw 35 is separated from the engaging surface 224 to face the outer guide surface 223.

As described above, once the user pivots the blade 2 that is located in the folded position to the switching position, after that, the blade 2 is allowed to be smoothly and easily pivoted to the open position using the urging force of the torsional spring 18. In this way, the knife according to the present disclosure has a blade open assisting function for pivotal movement of the blade 2 from the folded position to the open position performed by the user.

Since the blade open assisting function is achieved only with the movement of the movable member 30, the structure is simple and reliable.

The embodiment of the present disclosure may also be modified as follows.

The shape of the movable member 30 is not limited to the illustrated shape but may be modified as necessary. For example, as long as the movable member 30 smoothly moves without difficulty, the second pin 33 may be omitted from the movable member 30.

The moving distance (moving angle) of the blade 2 from the folded position to the switching position is modifiable as necessary by changing the circumferential length of the receiving hole 222 (outer guide surface 223). For example, the moving distance (moving angle) of the blade 2 from the folded position to the switching position becomes smaller by shortening the circumferential length of the receiving hole 222 (the outer guide surface 223).

It should be apparent to those skilled in the art that the present, disclosure may be embodied in many other specific forms without departing from the spirit or scope of the disclosure. Therefore, the present disclosure is not to be limited to the details given herein, but may be modified within the scope and equivalence of the appended claims.

The invention claimed is:

1. A folding knife comprising:

a handle having a pivot axis;

a blade attached to the handle, the blade being configured to pivot about the pivot axis to move between a folded position, at which the blade is received in the handle, and an open position, at which the blade extends out of the handle, wherein a direction in which the blade moves from the folded position toward the open position is an open direction, and the blade includes an engaging portion;

a movable member configured to move about the pivot axis, the movable member including an engaging claw capable of being engaged with the engaging portion of the blade;

an urging spring urging the movable member in the open direction; and a switching mechanism configured to switch the movable member between an engaged state, in which the movable member is movable relative to the handle and the engaging claw is engaged with the engaging portion of the blade, and a disengaged state, in which movement of the movable member relative to the handle is restricted and the engaging claw is disengaged from the engaging portion, wherein when the blade is in the folded position, the switching mechanism holds the movable member in the disengaged state, and when the blade has moved from the folded position to a switching position, which is between the folded position and the open position, the switching mechanism switches the movable member from the disengaged state to the engaged state, thereby moving the movable member in the open direction by the urging spring so that the blade is moved from the switching position toward the open position by the movable member.

2. A folding knife comprising:

a handle including a pivot axis, an inner guide surface extending in an arcuate shape about the pivot axis, and a holding portion extending radially inward from one end in a circumferential direction of the inner guide surface;

a blade attached to the handle, the blade being configured to pivot about the pivot axis to move between a folded position, at which the blade is received in the handle, and an open position, at which the blade extends out of the handle, wherein a direction in which the blade moves from the folded position toward the open position is an open direction, a direction in which the blade moves from the open position toward the folded position is a folding direction, the blade includes an outer guide surface that extends about the pivot axis and an engaging portion that extends radially outward from one end in a circumferential direction of the outer guide surface, and the outer guide surface is arranged radially outside the inner guide surface;

a movable member configured to move about the pivot axis along the inner guide surface, the movable member including a guided portion that is capable of being engaged with the inner guide surface and the holding portion of the handle and an engaging claw capable of being engaged with the outer guide surface and the engaging portion of the blade; and an urging spring urging the movable member in the open direction, wherein when the blade is in the folded position, the guided portion of the movable member is engaged with the holding portion of the handle and the outer guide surface of the blade radially faces the engaging claw of the movable member to restrict radially outward movement of the engaging claw, so that the guided portion is prevented from being separated from the holding portion, when the blade has moved from the folded position to a switching position, which is between the folded position and the open position, the engaging portion of the blade is located at a position at which the engaging portion radially faces the engaging claw, thereby allowing the engaging claw to move radially outward so that the engaging claw is engaged with the engaging portion and allowing the guided portion to separate from the holding portion, and in a state in which the guided portion is separated from the holding portion, the movable member is moved in the open direction by the urging spring so that the guided portion moves along the inner guide surface of the handle and the blade is moved from the switching position toward the open position by the engaging claw that is engaged with the engaging portion.

3. The folding knife according to claim 2, wherein the movable member includes a body that is positioned to radially face the outer guide surface and includes a first end and a second end, the guided portion is a projection that extends from the first end of the body in a direction parallel with the pivot axis and radially faces the inner guide surface, the engaging claw is a first engaging claw that projects radially outward at the first end, the body further includes a second engaging claw that projects radially inward at the second end, and the urging spring is engaged with the second engaging claw.

4. The folding knife according to claim 2, wherein the urging is a torsional spring arranged around the pivot axis, and the torsional spring includes a first end, which is engaged with the handle, and a second end, which is engaged with the movable member.

5. The folding knife according claim 2, wherein in a process in which the blade moves from the open position to the switching position, the movable member is moved with the blade in the folding direction by the engaging portion that is engaged with the engaging claw, in a process in which the blade moves toward the folded position beyond the switching position, the guided portion is guided to the holding portion, and along with this, the engaging claw is separated from the engaging portion and faces the outer guide surface.

6. The folding knife according claim 2, wherein the blade includes a receiving hole a part of which is defined by the outer guide surface and the engaging portion, and the movable member is arranged in the receiving hole.

* * * * *